US006780093B2

(12) United States Patent
Krondorfer et al.

(10) Patent No.: US 6,780,093 B2
(45) Date of Patent: Aug. 24, 2004

(54) TOOL MOUNTING

(75) Inventors: Harald Krondorfer, Ludwigsburg (DE); Markus Heckmann, Filderstadt (DE)

(73) Assignee: Robert Bosch GmbH, Stuttgart (DE)

( * ) Notice: Subject to any disclaimer, the term of this patent is extended or adjusted under 35 U.S.C. 154(b) by 119 days.

(21) Appl. No.: 10/018,327

(22) PCT Filed: Jun. 21, 2001

(86) PCT No.: PCT/DE01/01076

§ 371 (c)(1),
(2), (4) Date: Apr. 9, 2002

(87) PCT Pub. No.: WO01/76816

PCT Pub. Date: Oct. 18, 2001

(65) Prior Publication Data

US 2002/0115394 A1 Aug. 22, 2002

(30) Foreign Application Priority Data

Apr. 11, 2000 (DE) ..... 100 17 981

(51) Int. Cl.[7] ..... B24B 23/00
(52) U.S. Cl. ..... 451/344; 451/357; 451/359
(58) Field of Search ..... 451/344, 356, 451/357, 359

(56) References Cited

U.S. PATENT DOCUMENTS 4,730,952 A 3/1988 Wiley
5,733,183 A * 3/1998 Schierling et al. ..... 451/508
5,967,886 A * 10/1999 Wuensch et al. ..... 451/356
6,004,194 A * 12/1999 Hild et al. ..... 451/357
6,241,594 B1 * 6/2001 Lepold ..... 451/359
6,277,013 B1 * 8/2001 Sasaki et al. ..... 451/360
6,386,961 B1 * 5/2002 Cureton ..... 451/358

FOREIGN PATENT DOCUMENTS

| | | |
|---|---|---|
| DE | 41 05 340 A | 8/1992 |
| DE | 197 52 810 A1 | 6/1998 |
| EP | 0 904 896 A2 | 3/1999 |
| FR | 2 521 476 A | 8/1983 |

* cited by examiner

*Primary Examiner*—Eileen P. Morgan
(74) *Attorney, Agent, or Firm*—Michael J. Striker

(57) ABSTRACT

The invention is based on a tool receptacle, in particular for a hand-held angle grinding machine (10) or a circular power saw, having a slaving device (12, 14, 300), by way of which an insert tool (16) can be operatively connected to a drive shaft (18), and having a locking device (20), by way of which, with an actuation button (22), the drive shaft (18) can be locked upon mounting and/or removal of the insert tool (16).

Figure 1:
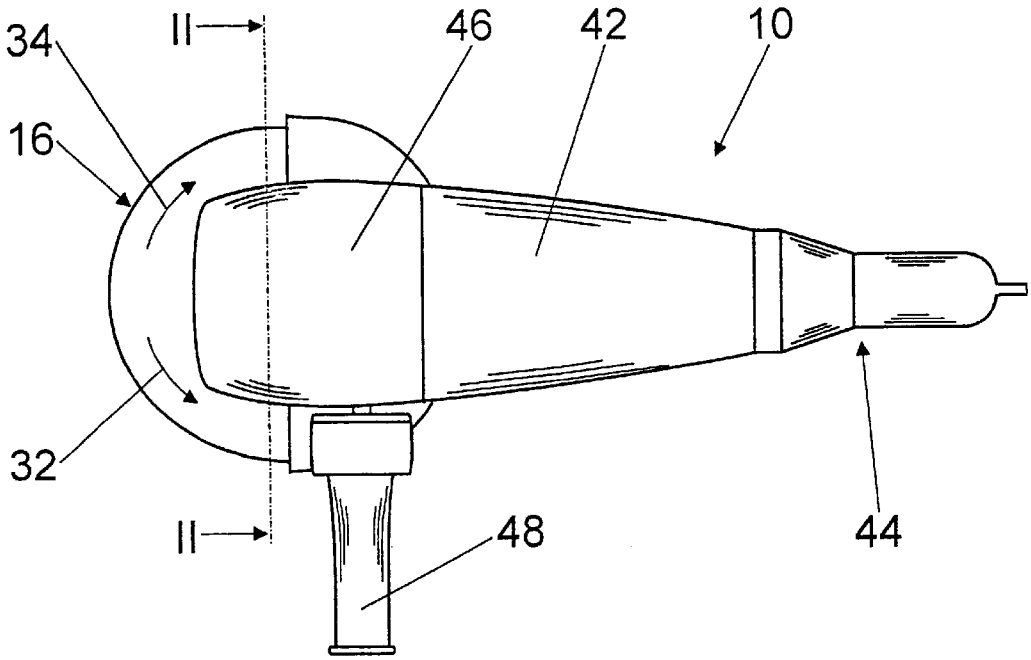

It is proposed that the actuation button (22) is operatively connected in the direction of rotation (32, 34) to the drive shaft (18), and by way of the actuation button (22), for locking the drive shaft (18), at least one first part (24), operatively connected in the direction of rotation (32, 34) to the drive shaft (18), can be connected to a second part (26), which is rotationally fixed with respect to a rotational axis of the drive shaft (18).

12 Claims, 5 Drawing Sheets

TOOL MOUNTING

PRIOR ART

The invention is based on a machine tool as generically defined by the preamble to claim 1.

To make it advantageously possible to connect an insert tool to a drive shaft of a machine tool via a tool receptacle, it is known to fix the drive shaft using a locking device.

For angle grinders, a locking device is known that has a locking bolt, guided in rotationally fixed fashion with respect to the drive shaft in a housing, which bolt can be brought into engagement, via an actuation button, with a set of teeth rotationally fixedly connected to the drive shaft.

From European Patent Disclosure EP 0 904 896 A2, a grinding machine tool receptacle for a hand-held angle grinding machine is also known. The angle grinding machine has a drive shaft that has a thread on the side toward the tool.

The grinding machine tool receptacle also has a slaving means and a lock nut. For mounting a grinding wheel, the slaving means is slipped with a mounting opening onto a collar of the drive shaft and braced against a bearing face of the drive shaft by nonpositive engagement via the lock nut. The slaving means has a collar, extending axially on the side toward the tool, that on two radially opposed sides on its outer circumference has recesses that extend axially as far as a bottom of the collar. From each of the recesses, a respective groove extends on the outer circumference of the collar, counter to the driving direction of the drive shaft. The grooves are closed counter to the driving direction of the drive shaft and taper axially, beginning at the recesses, counter to the drive direction of the drive shaft.

The grinding wheel has a hub with a mounting opening, in which two opposed tongues are disposed, pointing radially inward. The tongues can be introduced axially into the recesses and then in the circumferential direction, counter to the driving direction, into the grooves. The grinding wheel is fixed by positive engagement in the grooves in the axial direction via the tongues and by nonpositive engagement by means of the tapering contour of the grooves. During operation, the nonpositive engagement increases as a consequence of reaction forces exerted on the grinding wheel, which act counter to the driving direction.

To prevent the grinding wheel from coming to a stop when the drive shaft is braked by the slaving means, a stopper, which is movably supported in the axial direction in an opening, is disposed in the region of a recess on the circumference of the collar. In a working position where the grinding wheel points downward, the stopper is deflected axially by gravity in the direction of the grinding wheel and closes the groove in the direction of the recess and blocks a motion of the tongue, located in the groove, in the driving direction of the drive shaft.

ADVANTAGES OF THE INVENTION

The invention is based on a tool receptacle, in particular for a hand-held angle grinding machine or a circular power saw, having a slaving device, by way of which an insert tool can be operatively connected to a drive shaft, and having a locking device, by way of which, with an actuation button, the drive shaft can be locked upon mounting and/or removal of the insert tool.

It is proposed that the actuation button is operatively connected in the direction of rotation to the drive shaft, and by way of the actuation button, for locking the drive shaft, at least one first part, operatively connected in the direction of rotation to the drive shaft, can be connected to a second part, which is rotationally fixed with respect to a rotational axis of the drive shaft. Because of the actuation button that rotates with the drive shaft in operation, it can be reliably prevented that the actuation button is misused to brake the drive shaft. Slowing down of the insert tool to a stop as a result of an unintended major braking moment with the attendant risk of injury can be reliably avoided, and wear of the locking device can be reduced.

The embodiment of the invention can be employed in various tool receptacles that appear useful to one skilled in the art. It is especially advantageous, however, if the insert tool is operatively connectable to the slaving device via at least one detent element, supported movably counter to a spring element, which detent element snaps into place in an operating position of the insert tool and fixes the insert tool by positive engagement. Because of the positive engagement, an especially secure fastening of the insert tool can be attained. Moreover, with the movably supported detent element upon the installation of the insert tool, a major deflection of the detent element can be made possible, as a result of which on the one hand a major overlap between two corresponding detent elements and an especially secure positive engagement can be achieved, and on the other, a readily audible snapping-engagement noise can be achieved, which advantageously indicates to the user that the snap-in operation has been completed as desired.

In addition, a simple, economical, tool-less fast-action clamping system can be created, in which advantageously the movement of the detent element and/or the movement a component that is moved with the detent element can be utilized for the locking device of the drive shaft, which can be achieved especially simply in structural terms if the detent element is displaceably supported in the axial direction counter to the spring element. One or more components can be used to secure the insert tool and additionally for the locking device, and as a result additional components, installation space, and assembly effort and expense can be economized upon, especially if the detent element and/or a component movably supported with the detent element is connectable by the actuation button to the second part, which is rotationally fixed with respect to the rotational axis of the drive shaft, and the drive shaft is lockable in the circumferential direction.

Also in the tool receptacle proposed, in the installation and removal only slight torques to be absorbed by the locking device occur, and as a result the locking device can be designed as especially light in weight and economical.

The detent element can fix the insert tool by positive engagement either directly or indirectly via an additional component, for instance via a detent lever or tappet and the like that is coupled with the detent element and is supported rotatably and/or axially displaceably. The detent element can fix the insert tool by positive engagement directly and/or indirectly in various directions, such as the radial direction, axial direction, and/or especially advantageously the circumferential direction. It is also possible that as a result of the positive-engagement fixation of the insert tool with the detent element in a first direction, such as the radial direction, the insert tool is fixed by positive engagement in a second direction, such as the circumferential direction, by means of a component that is separate from the detent element.

The movably supported detent element can be embodied in various forms that appear useful to one skilled in the art, for instance as an opening, protrusion, peg, bolt and the like, and can be disposed on the insert tool and/or on the slaving device. The detent element itself can be supported movably in a component in a bearing location, for instance in a flange of the slaving device or in a tool hub of the insert tool. However, the detent element can advantageously also be solidly connected by nonpositive, positive and/or material engagement to a component supported movably in a bearing location, or can be embodied integrally with such a component, for instance with a component supported on the drive shaft or with a tool hub of the insert tool.

Also by means of the positive engagement, an advantageous encoding can be achieved, so that with the tool receptacle, only the insert tools intended can be secured. The slaving device can be embodied at least in part as a detachable adapter part, or it can be connected nondetachably to the drive shaft by nonpositive, positive and/or material engagement.

With the tool receptacle, various insert tools that appear useful to one skilled in the art can be secured, such as insert tools of an angle grinder for severing, grinding, rough-machining, brushing and so forth. A tool receptacle of the invention can also be used to secure a grinding plate of eccentric grinding machines.

In a further feature, it is proposed that the detent element and/or the component movably supported with the detent element is connectable by positive engagement to the second part that is rotationally fixed with respect to the rotational axis of the drive shaft, as a result of which, with little expenditure of force, secure locking of the drive shaft can be attained in a comfortable way. In principle, however, a nonpositive locking is also conceivable, especially in the tool receptacle of the invention, in which only slight torques have to be absorbed by the locking device in the installation and removal of the insert tool. In the event of an unintended actuation of the actuation button during operation, less wear is furthermore achievable compared with a positive-engagement locking device.

If the detent element can be released from its detent position by an unlocking button, then an independent release of the detent connection which could for instance be caused by a braking moment can be reliably prevented, thus enhancing safety. Operation of the insert tool in two circumferential directions can be made possible in principle, making it more convenient to install and remove the insert tool.

In a further feature of the invention, it is proposed that the actuation button of the locking device and the unlocking button are embodied integrally. Additional components, weight, installation effort and expense can all be economized on, and in particular convenience can be enhanced and usage can be simplified. By actuating the actuation button in one direction, a user can unlock the insert tool and at the same time lock the drive shaft.

Advantageously, at least one detent element, extending in the axial direction, is secured in a component that is supported displaceably on the drive shaft counter to a spring element. One and especially advantageously more than one detent elements can be guided well on the drive shaft over a large bearing area. Tilting of the detent elements and motion of the detent elements relative to one another can be reliably avoided, and with a spring element, which can advantageously be disposed rotationally symmetrically and concentrically, a desired spring force for a detent operation can be achieved. The component and/or the detent elements secured in the component can advantageously also be connected to the second part, which is rotationally fixed with respect to the rotational axis of the drive shaft, and torques that occur during the installation and removal can advantageously be absorbed.

If at least one detent element is formed integrally on a disklike component and/or if the first part, operatively connected to the drive shaft in the direction of rotation, is integrally formed onto a disklike component and/or if at least two elements for fixation of the insert tool in the axial direction are integrally formed onto a disklike component, then additional components and installation effort and expense can be saved. Furthermore, press-fitted connections between individual components with the attendant weak points can be avoided.

DRAWING

Further advantages will become apparent from the ensuing description of the drawings. Exemplary embodiments of the invention are shown in the drawing. The drawing, description and claims include numerous characteristics in combination. One skilled in the art will expediently consider the characteristics individually as well and put them together to make useful further combinations.

Figure 2:
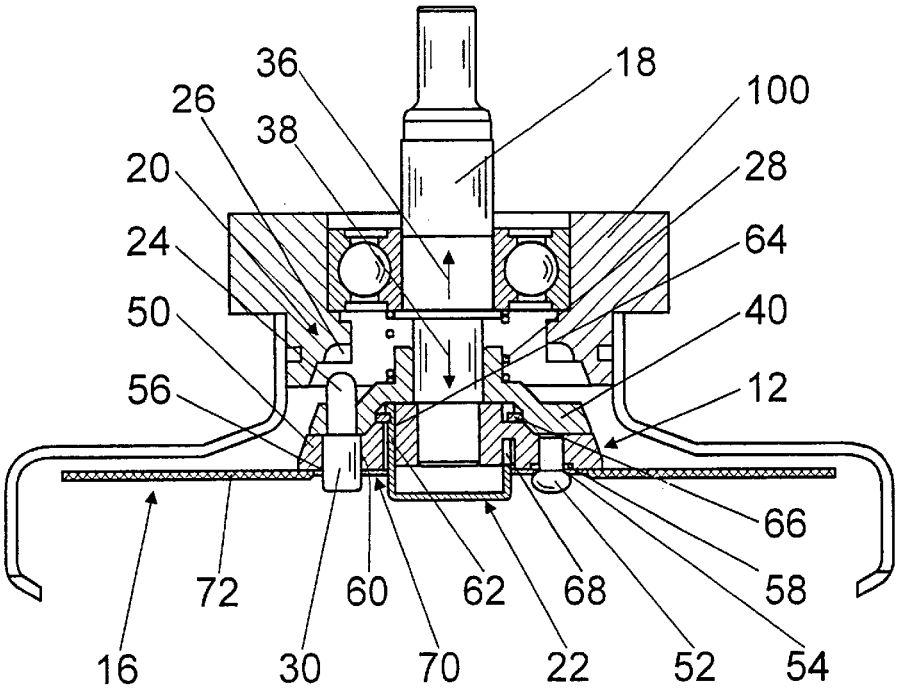
Figure 3:
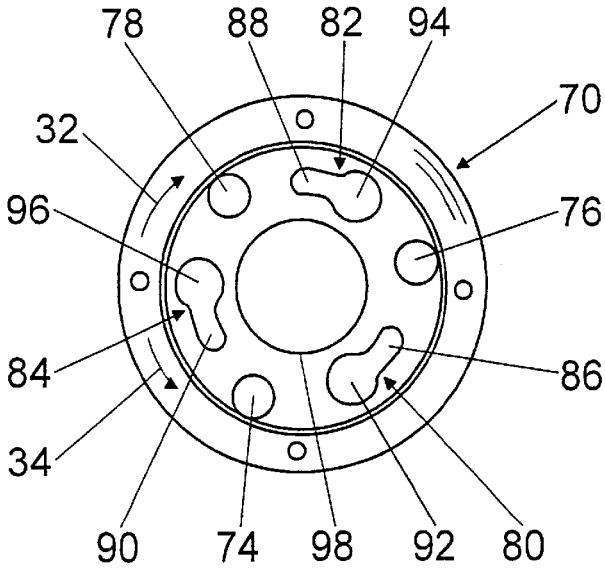
Figure 4:
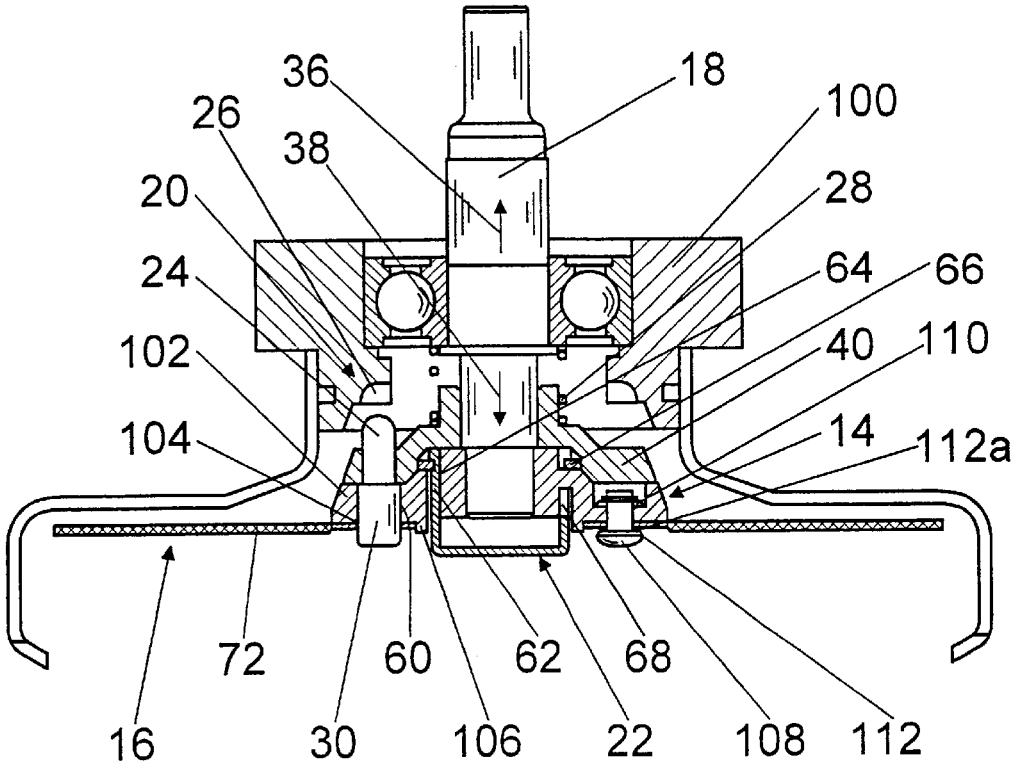
Figure 5:
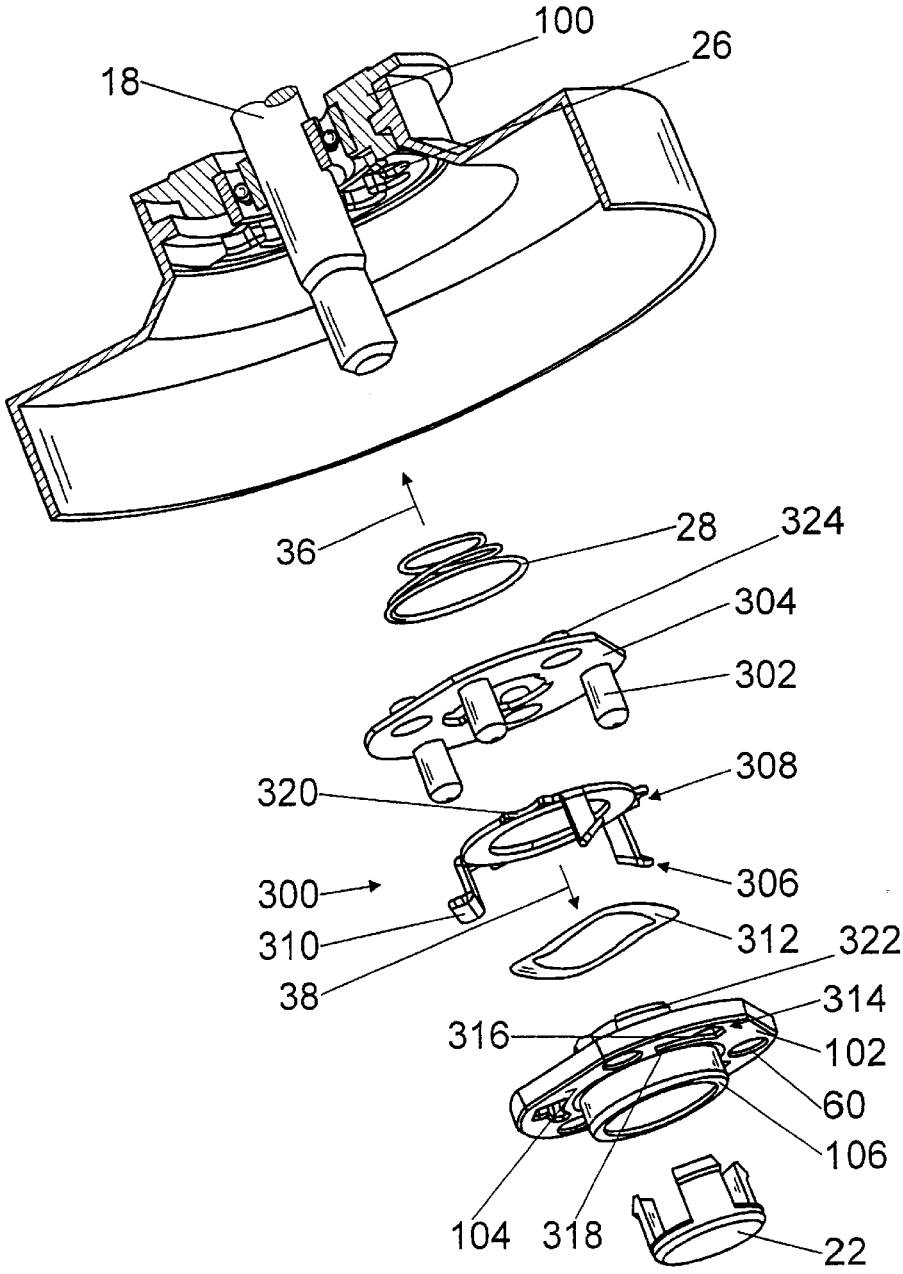
Figure 6:
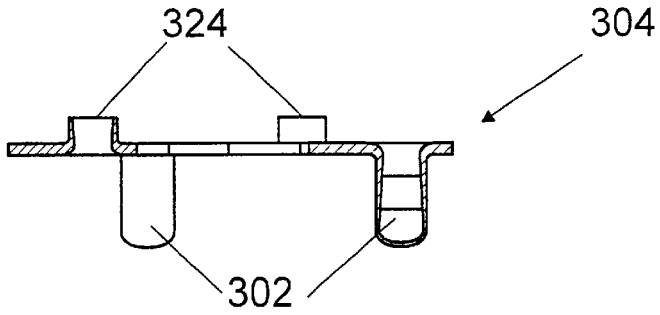
Figure 7:
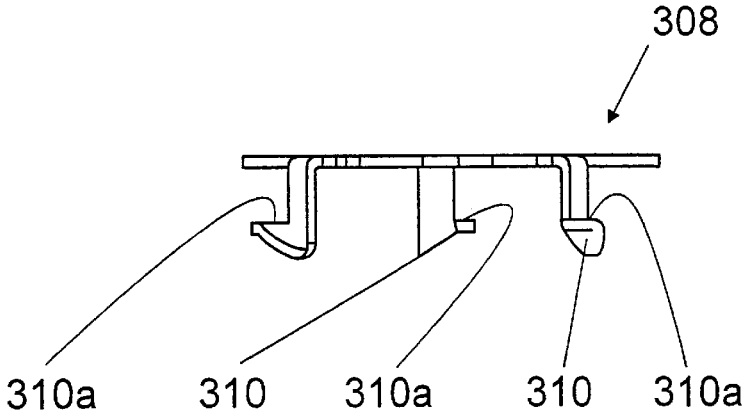

Shown are:

FIG. 1, an angle grinder from above;

FIG. 2, a schematic cross section taken along the line II—II of FIG. 1 through a grinding machine tool receptacle of the invention;

FIG. 3, a tool hub seen from below;

FIG. 4, a variant of FIG. 2;

FIG. 5, an exploded view of a variant of FIG. 4;

FIG. 6, a section through a slaving disk of FIG. 5 with a bolt formed onto it;

FIG. 7, a side view of a sheet-metal plate of FIG. 5; and

Figure 8:
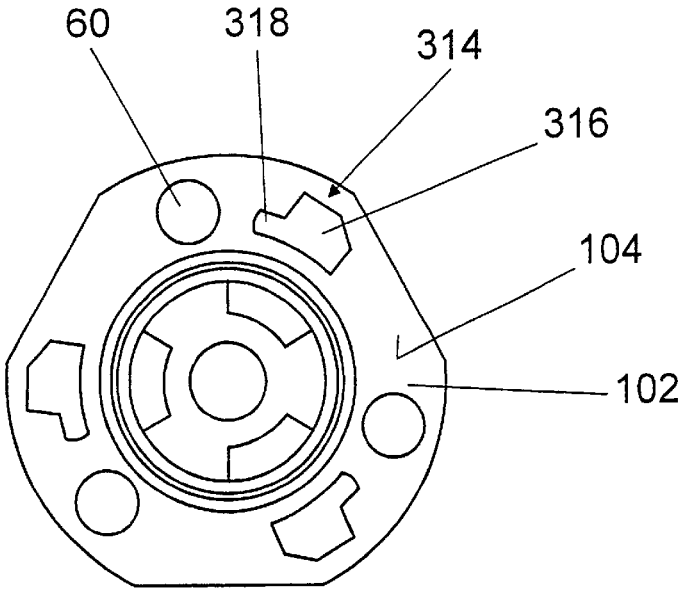

FIG. 8, a slaving flange from FIG. 5, seen from below.

FIG. 1 shows an angle grinding machine 10 from above, with an electric motor, not shown, supported in a housing 42. The angle grinding machine 10 can be guided via a first handle 44, which is integrated with the housing 42 on the side remote from a cutting disk 16 and extending longitudinally, and via a second handle 48, secured to a gearbox 46 in the region of the cutting disk 16 and extending transversely to the longitudinal direction.

With the electric motor, via a gear not shown, a drive shaft 18 can be driven, on whose end pointing toward the cutting disk 16 a slaving device 12 is disposed (FIG. 2). The slaving device 12, on a side toward the cutting disk 16, has a slaving flange 50 pressed firmly onto the drive shaft 18, and on a side remote from the cutting disk 16, it has a slaving disk 40 that is supported displaceably on the drive shaft 18 axially counter to a concentrically disposed helical spring 28. In the slaving flange 50, three pins 52, disposed at uniform intervals one after the other in the circumferential direction 32, 34 and extending in the axial direction 38 to the cutting disk 16 past the slaving flange 50 are press-fitted into the slaving flange 50. The pins 52, on their end pointing toward the cutting disk 16, each have one head, which has a larger diameter than a remainder of the pin 52, and on a side toward the slaving flange 50, this head has a conical transmission face 54 that narrows in the axial direction 36 toward the slaving flange 50. The slaving flange 50 forms an axial bearing face 56 for the cutting disk 16, which face defines an axial position of the cutting disk 16; recesses 58 are made in this face in the region of the pins 52. Three axial through bores 60 are also made in the slaving flange 50 one after the other in the circumferential direction 32, 34; specifically, one through bore 60 is disposed between each two pins 52 in the circumferential direction 32, 34.

Three bolts 30 are press-fitted one after the other in the circumferential direction 32, 34 into the slaving disk 40 that is supported axially displaceably on the drive shaft 18; these bolts extend in the axial direction 38 to the cutting disk 16 and, with a part 24, they extend past the slaving disk 40 in the axial direction 36 remote from the cutting disk 16. The slaving disk 40 is pressed by the helical spring 28 in the direction 38 toward the cutting disk 16 against the slaving flange 50 and is braced on the slaving flange. The bolts 30 protrude through the through bores 60 and extend in the axial direction 38 past the slaving flange 50.

The slaving device 12 also has a cup-shaped unlocking button, disposed centrally on the side toward the cutting disk 16; the unlocking button is embodied integrally with an actuation button 22 of a locking device 20 of the drive shaft 18. The unlocking button has three segments 62, distributed uniformly in the circumferential direction 32, 34 and extending in the axial direction 36 to the axially movably supported slaving disk 40, which segments reach through corresponding recesses 64 in the slaving flange 50 and are secured against falling out in the axial direction 38 via a snap ring 66 in the slaving disk 40. The unlocking button is guided displaceably in the axial direction 36, 38 in an annular recess 68 in the slaving flange 50.

The cutting disk 16 has a sheet-metal hub 70, which is connected solidly to a grinding means 72 via a rivet connection, not shown in detail, and pressed (FIG. 3). The tool hub could also be made of some other material appearing useful to one skilled in the art, such as plastic, and so forth. The sheet-metal hub 70, in succession in the circumferential direction 32, 34, has three uniformly distributed bores 74, 76, 78, whose diameter is slightly greater than the diameter of the bolts 30. The sheet-metal hub 70 also has three elongated slots 80, 82, 84, extending in the circumferential direction 32, 34 and distributed uniformly in the circumferential direction 32, 34, each having a respective narrow region 86, 88, 90 and a respective wide region 92, 94, 96 that is produced by means of a bore, and whose diameter is slightly greater than the diameter of the heads of the pins 52.

The sheet-metal hub 70 has a centering bore 98, whose diameter is advantageously selected such that the cutting disk 16 can be clamped on a conventional angle grinding machine using a conventional chucking system with a chucking flange and a spindle nut. This assures so-called downward compatibility.

Upon installation of the cutting disk 16, the cutting disk 16 is slipped with its centering bore 98 onto the unlocking button or actuation button 22 and centered radially. Next, the cutting disk 16 is rotated, until the pins 52 engage the wide regions 92, 94, 96, intended for them, in the elongated slots 80, 82, 84 of the sheet-metal hub 70.

Pressing the sheet-metal hub 70 against the bearing face 56 of the slaving flange 50 has the effect that the bolts 30 in the through bores 60 and also the slaving disk 40 are displaced counter to a spring force of the helical spring 28 axially on the drive shaft 18 in the direction 36 remote from the cutting disk 16. The part 24 of the bolts 30 that protrudes past the slaving disk 40 in the axial direction 36 remote from the cutting disk 16 is slipped into a plurality of pockets 26, distributed in the circumferential direction 32, 34, that are formed onto a bearing flange 100. The bearing flange 100 is screwed solidly in the gearbox 46. The pockets 26 are supported in rotationally fixed fashion with respect to a rotational axis of the drive shaft 18 or to the drive shaft 18, and the drive shaft 18 is locked by positive engagement in the circumferential direction 32, 34 via the slaving flange 50 and the bolts 30. The pockets 26 are embodied as open radially inward, as a result of which they can be prevented from becoming plugged with dirt and dust. The pockets 26 can also advantageously be embodied as open in the axial direction 36 remote from the cutting disk 16.

Further rotation of the sheet-metal hub 70 counter to the drive direction 34 has the effect that the pins 52 are displaced into the curved, narrow regions 86, 88, 90 of the elongated slots 80, 82, 84. In the process, with their conical transmission faces 54, the pins 52 press against the edges of the elongated slots 80, 82, 84 and press them elastically into the recesses 58 of the slaving flange 50. As a result, the sheet-metal hub 70 is pressed against the bearing face 56 and is fixed in the axial direction 36, 38.

In a terminal position, or in an operating position of the cutting disk 16 that is attained, the bores 74, 76, 78 in the sheet-metal hub 70 come to rest above the through bores 60 of the slaving flange 50. By the spring force of the helical spring 28, the bolts 30 are axially displaced out of the pockets 26 in the direction 38 of the cutting disk 16 and snap into the bores 74, 76, 78 of the sheet-metal hub 70 and fix the sheet-metal hub by positive engagement in both circumferential directions 32, 34. Upon snapping into place, a snapping noise that is audible to a user occurs, indicating operating readiness to the user.

A driving moment of the electric motor of the angle grinding machine 10 can be transmitted by the drive shaft 18 to the slaving flange 50 by nonpositive engagement and by the slaving flange 50 to the cutting disk 16 via the bolts 30 by positive engagement. In addition, a braking moment that occurs when the electric motor is switched off and thereafter and which is oriented counter to the driving moment can be transmitted by positive engagement from the slaving flange 50 to the cutting disk 16 via the bolts 30. Unintended loosening of the cutting disk 16 is reliably avoided. By means of the three bolts 30 uniformly distributed in the circumferential direction 32, 34, an advantageous uniform distribution of both force and mass is attained.

To release the cutting disk 16 from the angle grinding machine 10, the unlocking button is pressed. The slaving disk 40 is displaced with the bolts 30 via the unlocking button or actuation button 22, counter to the helical spring 28, in the axial direction 36 remote from the cutting disk 16, and as a result the bolts 30 move in the axial direction 36 out of their detent position, that is, out of the bores 74, 76, 78 of the sheet-metal hub 70. At the same time, with their parts 24, the bolts 30 engage the pockets 26, as a result of which the drive shaft 18 is locked by positive engagement in the direction of rotation 32, 34.

Next, the cutting disk 16 is rotated in the driving direction 34, specifically until the pins 52 come to rest in the wide regions 92, 94, 96 of the elongated slots 80, 82, 84, and the cutting disk 16 can be removed from the slaving flange 50 in the axial direction 38. Once the unlocking button is let go, the slaving disk 40, bolts 30 and unlocking button or actuation button 22 are displaced backward into their outset positions by the helical spring 28.

In FIG. 4, an alternative exemplary embodiment to the exemplary embodiment of FIG. 2 is shown, with a slaving device 14. Components that remain essentially the same are identified by the same reference numerals in the exemplary embodiments shown. Also, the description of the exemplary embodiment in FIGS. 2 and 3 can be referred to for characteristics and functions that remain the same.

The slaving device 14 has a slaving flange 102 pressed onto the drive shaft 18. A collar 106 is formed onto the slaving flange 102, which forms a bearing face 104 for the cutting disk 16; by way of this collar, the cutting disk 16 is radially centered in the state in which it is mounted with its centering bore 98. Radial forces can advantageously be absorbed by the slaving flange 102 without putting a load on the unlocking button.

Also in the slaving flange 102, three pins 108 distributed uniformly in the circumferential direction 32, 34 and extending in the axial direction 38 past the bearing face 104 are supported displaceably in the axial direction 38, each against a respective cup spring 110, for the sake of axial fixation of the cutting disk 16. Each of the pins 108, on its end pointing toward the cutting disk 16, has a head, which has a larger diameter than a remaining portion of the pin 108, and on a side toward the slaving flange 102, the pins have a conical bearing face 112, which tapers in the axial direction 36, and a bearing face 104 extending parallel to the bearing face 104. If the heads of the pins 108 are guided by the wide regions 92, 94, 96 of the elongated slots 80, 82, 84, then a rotation of the sheet-metal hub 70 counter to the driving direction 34 causes the pins 108 to be displaced into the curved narrow regions 86, 88, 90 of the elongated slots 80, 82, 84. In the process, the pins 108 are displaced axially in the direction 38, counter to the pressure of the cup springs 110, via the conical bearing faces 112 until the bearing faces 112*a* of the pins 108 cover the edges of the elongated slots 80, 82, 84 in the curved narrow regions 86, 88, 90.

In the installed state, the cup springs 110, via the bearing faces 112*a* of the pins 108, press the cutting disk 16 against the bearing face 104. Instead of being loaded with a plurality of cup springs 110, the pins can also be loaded via other spring elements that appear useful to one skilled in the art, such as helical springs, or via one cup spring, not shown, extending over the full circumference. The exemplary embodiment shown in FIG. 4, with the axially displaceably supported pins 108, is especially suitable for thick tool hubs or tool hubs that are not very deformable elastically.

In FIG. 5, an alternative exemplary embodiment to the exemplary embodiment of FIG. 4 is shown, with a slaving device 300. The slaving device 300 has a slaving flange 102, which forms a bearing face 104 for a cutting disk, not identified by reference numeral here. On the side toward the cutting disk, a collar 106 is formed onto the slaving flange 102, and by way of this collar the cutting disk with its centering bore is radially centered in the installed state. Radial forces can advantageously be absorbed by the slaving flange 102, without putting a load on an unlocking button 22.

On a side of the slaving flange 102 remote from the cutting disk, a sheet-metal plate 308 for axial fixation of the cutting disk is disposed, having three circumferentially uniformly distributed, integrally formed-on fastening elements 306 that extend in the axial direction 38. The fastening elements 306 are formed onto the sheet-metal plate 308 in a bending operation.

Upon installation, the slaving flange 102, a wave washer 312 and the sheet-metal plate 308 are pre-installed. In the process, the wave washer 312 is slipped onto a collar 322, pointing in the direction away from the cutting disk, of the slaving flange 102. Next, the fastening elements 306 of the sheet-metal plate 308, which on their free end have a hook-shaped extension with an oblique face 310 pointing in the circumferential direction (FIGS. 5 and 7), are guided in the axial direction 38 by recesses 314 of the slaving flange 102, specifically by widened regions 316 of the recesses 314 (FIGS. 5 and 7). By compression and rotation of the sheet-metal plate 308 and slaving flange 102 against one another, the wave washer 312 is pre-stressed, and the sheet-metal plate 308 and the slaving flange 102 are connected by positive engagement in the axial direction 36, 38, specifically in that the hook-shaped extensions are rotated into narrow regions 318 of the recesses 314 (FIGS. 5, 7 and 8). Next, loaded by the wave washer 312, the sheet-metal plate 308 is braced on the bearing face 104 of the slaving flange 102 via edges 310*a* of the hook-shaped extensions, which point axially in the direction away from the cutting disk.

Once the sheet-metal plate 308 with the formed-on fastening elements 306, the wave washer 312 and the slaving flange 102 have been pre-installed, a compression spring 28 and a slaving disk 304, with three circumferentially uniformly distributed, integrally formed-on bolts 302 extending in the axial direction 38, are slipped onto a drive shaft 54. The bolts 302 are formed onto a sheet-metal plate forming the slaving disk 304 in a deep-drawing operation (FIG. 6). Also formed onto the slaving flange 102 in a deep-drawing operation are boltlike parts 324, which point in the axial direction remote from the bolts 302.

Next, the pre-installed group of components, comprising the sheet-metal plate 308, wave washer 312 and slaving flange 102, are mounted on the drive shaft 18. In this operation, the bolts 302 are guided by recesses 320 formed onto the circumference of the sheet-metal plate 308 and by through bores 60 in the slaving flange 102, and in the installed state they reach through the through bores 60. The sheet-metal plate 308 and the slaving flange 102 are secured against rotating relative to one another via the bolts 302.

The slaving flange 102 is pressed onto the drive shaft 18 and then secured with a securing ring, not shown in detail. Instead of a press-fitted connection, however, other connections that appear useful to one skilled in the art are also conceivable, such as a threaded connection, and so forth.

Once in the installation of a cutting disk 16 (see FIGS. 3 and 4) the hook-shaped extensions of the fastening elements 306 are guided through the wide regions 92, 94, 96 of the elongated slots 80, 82, 84 of the sheet-metal hub 70 (FIG. 5), rotating the sheet-metal hub 70 counter to the driving direction 34 has the effect of displacing the hook-shaped extensions into the curved, narrow regions 86, 88, 90 of the elongated slots 80, 82, 84 of the sheet-metal hub 70. In the process, the sheet-metal plate 308 with the fastening elements 306 is displaced axially in the direction 38 via the oblique faces 310 counter to the pressure of the wave washer 312, until the edges 310*a* of the hook-shaped extensions come to rest in curved, narrow regions 86, 88, 90 laterally next to the elongated slots 80, 82, 84 of the sheet-metal hub 70.

Pressing the sheet-metal hub 70 against the bearing face 56 of the slaving flange 102 has the effect that the bolts 302 and the slaving disk 304 are displaced axially, in the direction 36 remote from the cutting disk 16, on the drive shaft 18 counter to the spring force of the helical spring 28. The parts 324 of the slaving disk 304 that protrude past the slaving disk 304 in the axial direction 36 remote from the cutting disk 16, are pushed into a plurality of pockets 26, formed onto a bearing flange 100 and distributed in the circumferential direction 32, 34. The bearing flange 100 is solidly screwed into the gearbox 46. The pockets 26 are supported such that they are rotationally fixed with respect to a rotational axis of the drive shaft 18, or to the drive shaft 18, and the drive shaft 18 is locked by positive engagement in the circumferential direction 32, 34 via the slaving flange

102 and via the bolts 302. The pockets 26 are embodied as open radially inward, which can prevent them from becoming plugged with dirt and dust. The pockets 26 could also advantageously be embodied as open in the axial direction 36 remote from the cutting disk 16.

In the installed state, the wave washer 312, via the edges 310*a* of the hook-shaped extensions, presses the cutting disk 18 against the bearing face 104.

Alternatively, the fastening elements and elongated slots in the sheet-metal hub could be embodied as rotated by 180°, reversing the direction of installation, and the sheet-metal hubs would be rotated in the driving direction upon assembly. If the fastening elements are embodied as rotated by 180°, then in operation an oblique face of a lower face-end edge of the fastening element is in the lead, so that injuries from the face-end edge can be prevented.

List of Reference Numerals

10 Angle grinding machine
12 Slaving device
14 Slaving device
16 Insert tool
18 Drive shaft
20 Locking device
22 Actuation button
24 Part
26 Part
28 Spring element
30 Detent element
32 Circumferential direction
34 Circumferential direction
36 Direction
38 Direction
40 Component
42 Housing
44 Handle
46 gearbox
48 Handle
50 Slaving flange
52 Pin
54 Transmission face
56 bearing face
58 Recess
60 Through bore
62 Segments
64 Recess
66 Snap ring
68 Recess
70 Sheet-metal hub
72 Grinding means
74 Bore
76 Bore
78 Bore
80 Elongated slot
82 Elongated slot
84 Elongated slot
86 Region
88 Region
90 Region
92 Region
94 Region
96 Region
98 Centering bore
100 Bearing flange
102 Slaving flange
104 Bearing face
106 Collar
108 Pin
110 Cup spring
112 Bearing face
300 Slaving device
302 Detent element
304 Component
306 Element
308 Component
310 Oblique face
310*a* Edge
312 Spring element
314 Recess
316 Region
318 Region
320 Recess
322 Collar
324 Part

What is claimed is:

1. A tool receptacle for a hand-held angle grinding machine or a circular power saw, comprising a slaving device for operatively connecting an insert tool to a rotatable drive shaft: a locking device for looking with an actuation button the drive shaft upon mounting and removal of the insert tool, the actuating button being operatively connected in a direction of rotation of the drive shaft to the drive shaft and being operative for connecting at least one first part which is operatively connected in the direction of rotation to the drive shaft, to a second part which is rotationally fixed with respect to a rotational axis of the drive shaft.

2. A tool as defined in claim 1, and further comprising at least one detent element for operatively connecting the insert tool to the slaving device and supported movably counter to a force of a spring element, the at least one detent element snapping into place in an operating position on the insert tool and fixing the insert tool by positive engagement.

3. A tool as defined in claim 2, wherein at least one element selected from the group consisting of the detent element and a component movably supported with the detent element is connectable by the actuation button to the second part which is rotationally fixed with respect to the rotational axis of the drive shaft, while the drive shaft is lockable in a circumferential direction.

4. A tool as defined in claim 2, wherein at least one element selected from the group consisting of the detent element and the component movably supported by the detent element is connectable by positive engagement to the second part that is rotationally fixed with respect to the rotational axis of the drive shaft.

5. A tool as defined in claim 3, wherein at least one element selected from the group consisting of the detent element and the component movably supported with the detent element is connectable by frictional engagement to the second part that is rotationally fixed with respect to the rotational axis of the drive shaft.

6. A tool as defined in claim 2, wherein the detent element is displaceable in an axial direction of the shaft counter to the force of the spring element.

7. A tool as defined in claim 2; and further comprising an unlocking button with which the detent element is releasable from its detent position.

8. A tool as defined in claim 7, wherein the actuation button and the unlocking button are formed integrally with one another.

9. A tool as defined in claim 2, wherein the at least one detent element extends in an axial direction of the shaft and is secured in a component that is supported displaceably on the drive shaft counter to the force of the spring element.

10. A tool as defined in claim 2; and further comprising a disc-shaped component on which the at least one detent element is formed integrally.

11. A tool as defined in claim 1; and further comprising a disc-shaped component on which the first part operatively connected to the drive shaft in the direction of rotation of the drive shaft is integrally formed.

12. A tool as defined in claim 1; and further comprising a disc shaped component; and at least two elements provided for fixation of the insert tool in an axial direction of the shaft and integrally formed with the disc-shaped component.

* * * * *